US011608976B2

(12) United States Patent
Glasper

(10) Patent No.: US 11,608,976 B2
(45) Date of Patent: Mar. 21, 2023

(54) KNEE GEAR

(71) Applicant: El' DreaQuanTee Glasper, Bethlehem, GA (US)

(72) Inventor: El' DreaQuanTee Glasper, Bethlehem, GA (US)

( * ) Notice: Subject to any disclaimer, the term of this patent is extended or adjusted under 35 U.S.C. 154(b) by 0 days.

(21) Appl. No.: 17/356,347

(22) Filed: Jun. 23, 2021

(65) Prior Publication Data

US 2021/0317980 A1 Oct. 14, 2021

Related U.S. Application Data

(60) Provisional application No. 63/025,411, filed on May 15, 2020.

(51) Int. Cl.

| | |
|---|---|
| ***F21V 33/00*** | (2006.01) |
| ***F21S 9/02*** | (2006.01) |
| ***A41D 13/06*** | (2006.01) |
| ***A41D 27/08*** | (2006.01) |
| ***F21V 23/04*** | (2006.01) |
| ***F21Y 115/10*** | (2016.01) |

(52) U.S. Cl.

CPC ..... *F21V 33/0008* (2013.01); *A41D 13/065* (2013.01); *A41D 27/085* (2013.01); *F21S 9/02* (2013.01); *F21V 23/0471* (2013.01); *F21Y 2115/10* (2016.08)

(58) Field of Classification Search

CPC ..... A41D 13/01; A41D 13/06–065; A41D 13/27–085; F21S 9/02; F21V 23/0471; F21V 33/0008; F21Y 2115/10

See application file for complete search history.

(56) References Cited

U.S. PATENT DOCUMENTS 5,716,120 A * 2/1998 Hung ..... A41D 13/08 362/253

FOREIGN PATENT DOCUMENTS

DE 20207345 U1 * 12/2002 ..... A41D 13/01
KR 20120007105 U * 10/2012
WO WO-2008090314 A1 * 7/2008 ..... A41D 13/01

* cited by examiner

*Primary Examiner* — Jason M Han
(74) *Attorney, Agent, or Firm* — Barry Choobin; Patent 360

(57) ABSTRACT

A knee gear for protecting a knee from external impacts and illuminating a path of a user. the knee gear can be wrapped around the knee using straps. The knee gear includes one or more lights to couple to a cover member or an elongated pad of the knee gear.

9 Claims, 2 Drawing Sheets

KNEE GEAR

CROSS-REFERENCE TO RELATED APPLICATIONS

This application claims priority from the U.S. provisional patent application Ser. No. filed 63/025,411, filed on May 15, 2020, which is incorporated herein by reference in its entirety.

FIELD OF INVENTION

The present invention relates to a knee gear, and more particularly, the present invention relates to a knee gear with padding and lights.

BACKGROUND

Knee guards, also known as kneepads, are known in the art of protecting the knee against injuries. Knee guards can be wrapped around a knee and have cushioned pads to protect against impact injury from falling on the ground or hitting an obstacle. The amount of cushioning varies with the risk, for example, thick cushion pads provide a stronger buffer against accidental impacts in sports. The knee guards have a limited utility of protecting the knee joints against injury. Most of the research in the art has been around increasing the impact resistance of the knee guards or making the knee guards more ergonomic to wear.

A desire is always there to have multifunctional articles that can both decrease the overall cost and increase the performance of an individual.

The term "user" hereinafter refers to a person wearing or about to wear or wish to wear the disclosed knee gear.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a multifunctional knee gear.

It is another object of the present invention that the knee gear protects the knees from an external impact injury.

It is still another object of the present invention that the knee gear can illuminate a path of a user.

It is still another object of the present invention that the knee gear can illuminate articles on the floor, or a wall positioned up to a height of the knees.

It is a further object of the present invention that the knee gear is economical to manufacture.

It is still a further object of the present invention that the knee gear avoids the need of holding a flashlight in a hand.

It is yet a further object of the present invention that the knee gear allows a user to comfortably kneel on the knees.

It is an additional object of the present invention that the knee gear can help to enhance the performance of a user.

In one aspect, disclosed is a knee gear that can include a cover member configured to cover a knee; an elongated pad coupled to an outer side of the cover member; and a plurality of straps configured to wrap around the knee for securing the knee gear over the knee; and one or more lights coupled to the cover member or the elongated pad. The lights can have a light source, such as LEDs. In one implementation, two lights can be provided i.e., an upper light and a lower light coupled to the elongated pad, wherein the upper light is coupled near a top edge of the elongated pad and the lower light is coupled near a bottom edge of the elongated pad.

In one implementation, the light includes a housing that has a transparent cover; a light source encased in the housing adjacent to the transparent cover; a control mechanism configured to turn the light source on and off; and a power source configured to power the light source. The power source can be a battery also encased in the housing. The battery can be rechargeable or disposable. Preferably, the housing and the transparent cover can be made of a sturdy material that can withstand external impacts, such as a user fall on the floor with light between the elongated pad and the floor. The external impact can be a collision with an object in the path of the user. In one implementation, the control mechanism can be a push-button or gesture control, wherein the gesture control is configured to activate by flexing the knee. Moreover, the upper light and the lower light can have a common control mechanism. The control mechanism can further be configured to increase and decrease the intensity of the light source.

In one implementation, an upper light of the one or more lights can be coupled to the cover member and a lower light can be coupled to the elongated pad, wherein the upper light can be coupled near a top edge of the cover member and the lower light can be coupled near a bottom edge of the elongated pad.

These and other objects and advantages of the embodiments herein and the summary will become readily apparent from the following detailed description taken in conjunction with the accompanying drawings.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Disclosed is a multifunctional knee gear that can prevent knee injuries by proving protection against external impact and can also illuminate a path of the user. The disclosed knee gear can be particularly useful in dark or low light conditions by illuminating a path and objects in the path of the user. Disclosed knee gear avoids a need to hold a flashlight in hand—freeing up the hand from holding the flashlight can enhance the performance of a user i.e., the user can now use both hands to perform a task. The disclosed knee gear can allow a user to comfortably kneel on the knees for a long duration, wherein the knee gear provides a suitable cushioning against the hard floor.

Figure 1:
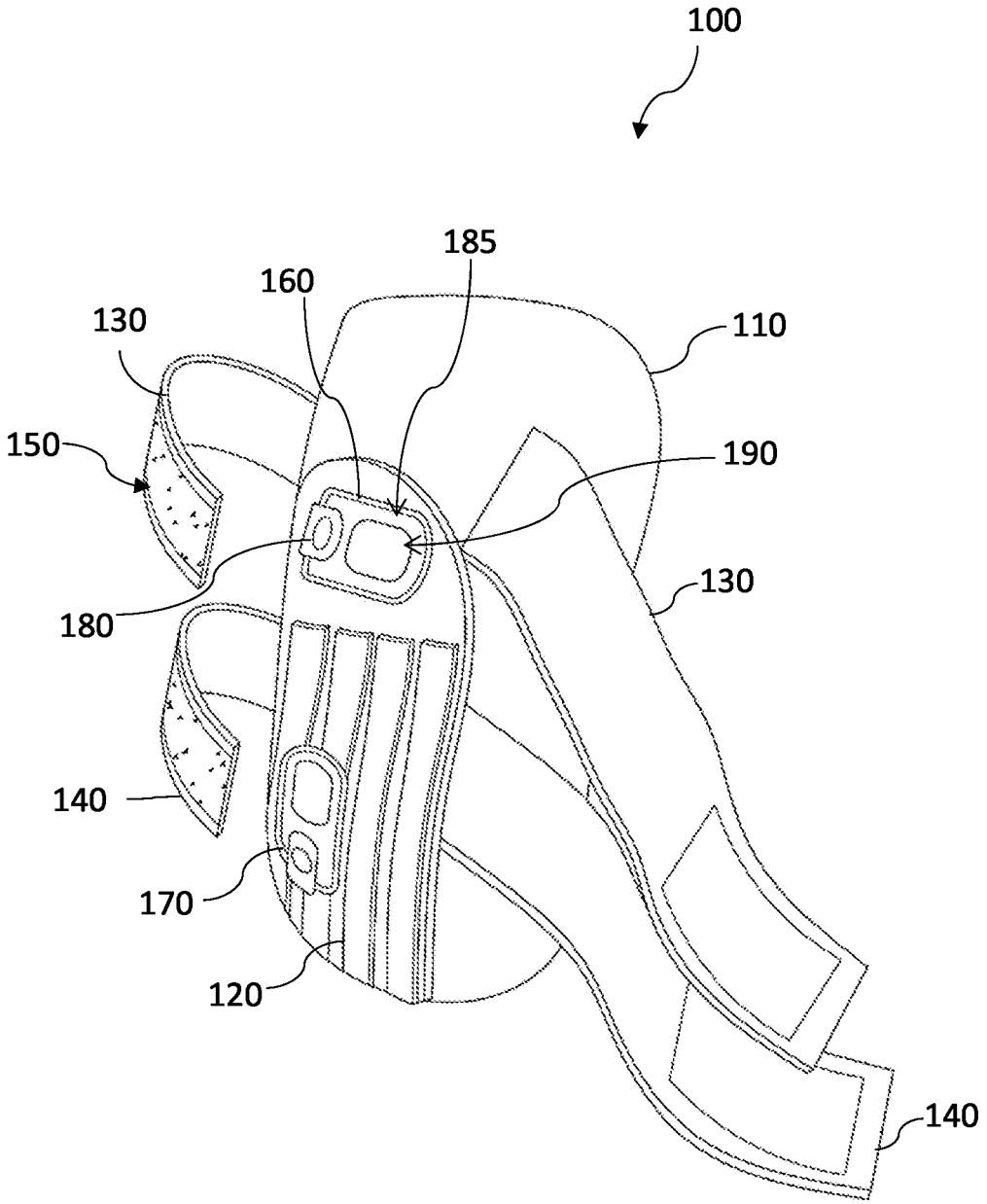
FIG. 1 is a perspective view of a knee gear, according to an exemplary embodiment of the present invention.

Referring to FIG. 1, which shows an exemplary embodiment of the knee gear 100 that can be wrapped around a knee of a user. The knee gear 100 can include a cover member 110 that contacts the skin when the user wears the knee gear 100. The cover member 110 can be made from a skin-friendly material that can comfortably be worn over a long duration. The material of the cover member can be elastic for an ergonomic fit over the knee without affecting the flexing of the knee. Moreover, the cover member 110 can be made from a durable material to which the cushioned pads can be coupled. At least an innermost layer of moisture-wicking material can also be provided for additional comfort, particularly in warm weather.

Furthermore, it can be seen in FIG. 1 can be an elongated pad 120 coupled to an outer side of the cover member 110. The elongated pad 120 can be positioned to cover the knee such as upon kneeling, the elongated pad 120 acts as a buffer between the floor the knee. Thus, in case of an accidental fall, the elongated pad 120 can protect the knee from impact injury. The amount of cushioning in the elongated pad 120 can be varied based on the work or event. For example, while walking, the knee gear 100 with less cushioning can provide enough protection against rubs and accidental fall. For a work, that requires kneeling on the knees, such as repairing an electrical socket mounted at a lower height on a wall, the electrician must kneel on the floor for a long duration to repair the socket. The knee gear 100 can provide cushioning against the hard floor and the electrician can work for a long duration comfortably.

The knee gear 100 can also have a pair of straps that can be wrapped around the knee for securing the knee gear 100 over the knee. Each pair of straps can include two strap members that can be coupled to the cover member 110 at opposite sides. The free end of the strap member can have mating members, such as a hook and loop fastener, that allow engaging the two strap members. FIG. 1 shows two upper strap members 130 and two lower strap members 140. Each of the upper strap members 130 and the lower strap members 140 have a hook and loop fastener 150.

Two light sources i.e., an upper light 160 and a lower light 170 can also be seen in FIG. 1 coupled to the elongated pad 120. The distance between the upper light 160 and the lower light 170 can be varied without departing from the scope of the present invention. Each light can have one or more LEDs and an inbuilt battery. The battery can be rechargeable or replaceable. It is to be understood that LEDs can be replaced by any similar light source, and such light source known to a skilled person for use in flashlights is within the scope of the present invention. Each the upper light 160 and the lower light 170 can be connected, such as both can be turned on using a single button. Alternatively, the upper light 160 and the lower light 170 can be independent of each other such as both can be provided with separate power buttons. FIG. 1 shows the upper light 160 and the lower light 170 having a power button 180. The power button 180 can regulate the power supply to the LEDs and can turn the LEDs on and off. The power button 180 can be a push-button, wherein the same push button can be used to turn the LEDs on and off. The power button can be a part of a control mechanism that can control turning the lights on and off and changing the brightness levels of the light. A suitable control button can also be provided to switch the LEDs between different brightness levels, such as the user can increase or decrease the brightness of the LEDs as desired. Either the same power button can be configured as a push and dial button, wherein the power button 180 can be rotated to different levels to increase or decrease the intensity of the LEDs. Besides the use of push and dial buttons, suitable gesture controls can also be provided for turning the LEDs on and off and changing the brightness levels of the LEDs. For example, the user can flex the leg to turn the LEDs on and off. To avoid, switching off the LED when a person kneels, the gesture may require a complete flex cycle i.e., bend followed by straightening the leg. In one case, one of the upper light 160 or the lower light 170 can be gesture controlled while the other light can have a power button. It is to be understood that FIG. 1, shows the knee gear 100 has two lights, however, one or more lights on the knee gear 100 are within the scope of the present invention. Moreover, FIG. 1 shows both the lights i.e., the upper light 160 and the lower light 170 coupled to the elongated pad 120, however, the upper light and the lower light can be coupled either to the elongated pad 120 or the cover member 110, or one light can be coupled to the cover member 110 while the other light can be coupled to the elongated pad 120, and any such arrangement of the one or more lights on the knee gear 100 is within the scope of the present invention. The LEDs can be encased in a housing 185 having a transparent cover 190. In a preferred embodiment, the housing 185 of the lights including the transparent cover 190 can be rugged, that can withstand external impacts. Also, the housing may withstand the weight of the user in case the user kneels on the floor, upon the light. It is to be understood that the position of the lights in the knee gear 100 can be optimized, varied, or customized according to the requirements of a user, and any such position of lights including the distance between the lights is within the scope of the present invention.

Figure 2:
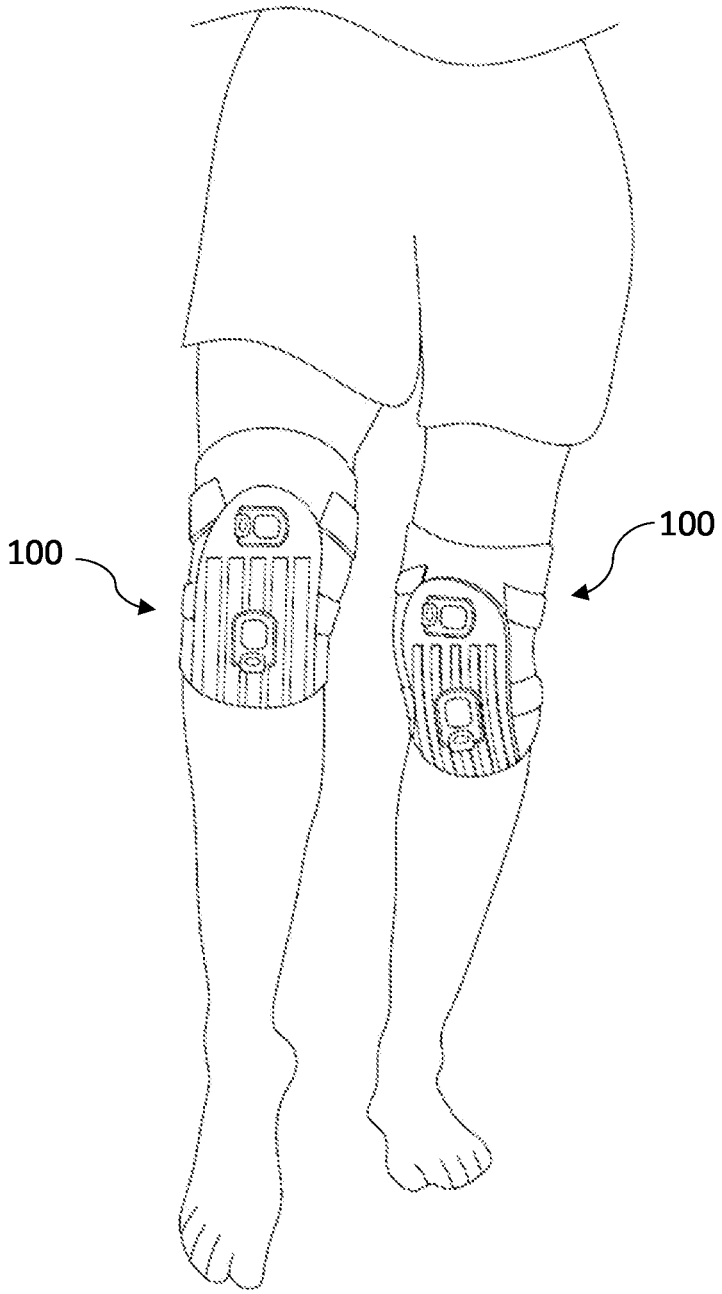
FIG. 2 shows the knee gear worn around the knees of a user, according to an exemplary embodiment of the present invention.

Referring to FIG. 2 which shows a user wearing the disclosed knee gear 100 in both legs. The user can turn on any number of the four lights on the left and right knee gear 100. The disclosed knee gear 100 can be both multifunctional and multipurpose utility devices. The position of the lights at the knee level can offer several advantages and applications. In one case, the lights can illuminate a path of the user. While walking in dark, the user can see the path and any obstacles in the path. The pads can protect any knee injury from an accidental fall or collision with any obstacle in the path of the user. Working on an article on the floor or mounted to a low height on the wall in low light or dark, the disclosed knee gear 100 can illuminate the article. The user does not have to hold a flashlight in hand while working, thus the hand can be used for any other purpose, increasing the performance of the user. Even while walking in low light or dark, the user may not need to carry a flashlight or hold the flashlight in hand. In case, an electrical socket has to be repaired, the electricity is generally cut off to prevent any shock during the repair. In case, the socket is mounted near a knee height, the user has to kneel on his knee for a long duration. The disclosed knee gear 100 can provide a cushion against the hard floor, thus the user can comfortably work for a longer duration without pain in the knees. Moreover, the lights of the knee gear 100 can illuminate the socket, thus the user does not have to hold the flashlight in hand, and the user can use the hand for repair. The disclosed knee gear 100 can be particularly advantageous by illuminating a path and objects at low height either on the floor or mounted to a wall.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A knee gear comprising:

a cover member configured to cover a knee;

an elongated pad coupled to an outer side of the cover member;

a plurality of straps configured to wrap around the knee for securing the knee gear over the knee; and one or more lights coupled to the cover member or the elongated pad, a control mechanism configured to turn the one or more lights on and off, the control mechanism is gesture control, the gesture control comprises bending a leg followed by straightening the leg.

2. The knee gear according to claim 1, wherein an upper light and a lower light of the one or more lights are coupled to the elongated pad, wherein the upper light is coupled near a top edge of the elongated pad and the lower light is coupled near a bottom edge of the elongated pad, wherein the elongated pad is positioned on the cover member such that the elongated pad lies between the knee and a floor when a wearer of the knee pad kneels on the floor.

3. The knee gear according to claim 2, wherein each of the upper light and the lower light comprises:

a housing that has a transparent cover;

a light source encased in the housing adjacent to the transparent cover; and a power source configured to power the light source.

4. The knee gear according to claim 3, wherein the power source is a battery also encased in the housing.

5. The knee gear according to claim 3, wherein the light source is one or more LEDs.

6. The knee gear according to claim 3, wherein the housing and the transparent cover is made of a sturdy material that can withstand external impacts.

7. The knee gear according to claim 3, wherein the upper light has a push button to turn the upper light on and off, the lower light has the control gesture.

8. The knee gear according to claim 7, wherein the upper light is coupled to the cover member, the lower light is coupled to the elongated pad, wherein the upper light is coupled near a top edge of the cover member and the lower light is coupled near a bottom edge of the elongated pad.

9. The knee gear according to claim 8, wherein the push button is configured to be rotated for increasing or decreasing an intensity of the light source.

* * * * *